US010561285B2

(12) United States Patent
Yang

(10) Patent No.: US 10,561,285 B2
(45) Date of Patent: Feb. 18, 2020

(54) QUICK DETACHABLE TOILET SEAT

(71) Applicant: Taizhou Zhongyi Sanitary Ware Co., Ltd., Xinghua, Jiangsu province (CN)

(72) Inventor: Huiming Yang, Xinghua (CN)

(73) Assignee: TAIZHOU ZHONGYI SANITARY WARE CO., LTD., Xinghua (CN)

( * ) Notice: Subject to any disclaimer, the term of this patent is extended or adjusted under 35 U.S.C. 154(b) by 0 days.

(21) Appl. No.: 16/033,905

(22) Filed: Jul. 12, 2018

(65) Prior Publication Data

US 2019/0350418 A1 Nov. 21, 2019

(30) Foreign Application Priority Data

May 18, 2018 (CN) ..... 2018 1 0482170

(51) Int. Cl.
*A47K 13/12* (2006.01)

(52) U.S. Cl.
CPC ..... *A47K 13/12* (2013.01)

(58) Field of Classification Search
CPC ..... A47K 13/12
USPC ..... 4/236
See application file for complete search history.

(56) References Cited

U.S. PATENT DOCUMENTS

2013/0117919 A1* 5/2013 Peng ..... A47K 13/12 4/236

FOREIGN PATENT DOCUMENTS

EP 119020 A2 9/1984

* cited by examiner

*Primary Examiner* — Lori L Baker
(74) *Attorney, Agent, or Firm* — John Alumit

(57) ABSTRACT

A quick detachable toilet cover includes a hollow casing which is arranged at the rear end of a cover assembly as well as adaptor mechanisms and damping mechanisms which are axially and serially arranged in the hollow casing, in which the adaptor mechanisms are matched with support poles on a toilet seat body, and the damping mechanisms are connected between the cover assembly and the hollow casing; the damping mechanisms are also sheathed with positioning sleeves, the damping mechanisms are located at and co-operated with the positioning sleeves along a circumferential direction, and the positioning sleeves are positioned and matched with the hollow casing along a circumferential direction.

11 Claims, 7 Drawing Sheets

QUICK DETACHABLE TOILET SEAT

CROSS-REFERENCE TO RELATED APPLICATION(S)

This application claims priority to Chinese Patent Application No. 201810482170.6, filed on May 18, 2018, the content of which is hereby incorporated by reference in its entirety.

TECHNICAL FIELD

The present disclosure relates to a quick detachable toilet cover.

BACKGROUND

A toilet cover in the existing technology generally includes a seat ring, an upper cover and a mounting bracket, wherein, the seat ring and the upper cover are arranged on a toilet seat body through the mounting bracket, the seat ring and the upper cover can rotate around a spindle in a horizontal direction, the spindle is connected to the toilet seat body through support poles which are vertical to a horizontal direction. For example, in a hinge for toilet seat, a spindle can be provided with a connector, the connector can be fixedly connected with a damping mechanism, and a blind hole can be formed on the connector, when installing, the support poles on the toilet seat body are inserted into the blind hole of the connector.

A problem of the above hinge structure is that due to the fixed connection of the connector and the damping mechanism, when the seat ring or the toilet cover overturns, the damping mechanism rotates and applies a certain twisting force to the connector, and the twisting force will be transmitted further to the support poles on the toilet seat body, thereby reducing the integral installation strength of the toilet cover.

SUMMARY

Accordingly, it is an object of the present disclosure is to provide a quick detachable toilet cover. Due to the relative separation of the adaptor mechanisms and the damping mechanisms, force transmission between the adaptor mechanisms and the damping mechanisms does not happen, thereby improving the integral installation strength of the toilet cover.

To achieve the above object, the technical solution adopted by the present disclosure is as follows:

A quick detachable toilet cover includes a hollowing casing (20) which is arranged at the rear end of a cover assembly (10) as well as adaptor mechanisms (30) and damping mechanisms (50) which are axially and serially arranged in the hollow casing (20), wherein, the adaptor mechanisms (30) are matingly engageable with support poles (80) on a toilet seat body, and the damping mechanisms (50) are connected between the cover assembly (10) and the hollow casing (20); the damping mechanisms (50) are also sheathed with positioning sleeves (40), the damping mechanisms (50) are located at and co-operate with the positioning sleeves (40) along a circumferential direction, and the positioning sleeves (40) are located at and co-operate with the hollow casing (20) along a circumferential direction.

Preferably, the damping mechanisms (50) include damping seats (51) and damping shafts (52), the positioning sleeves (40) are provided with positioning cavities (42), and the insertion of the damping shafts (52) into the positioning cavity (42) can achieve positioning and matching along a circumferential direction.

Preferably, the rear end of the cover assembly (10) is also provided with integrated sleeve holes (11), and the hollow casing (20) and the sleeve holes (11) are communication, and the damping seats (51) are extended into the sleeve holes (11), and positioned and co-operate with the sleeve holes (11) along a circumferential direction.

Preferably, first positioning ribs (41) extending in an axial direction are arranged on outer circumferential surfaces of the positioning sleeve (40), and an inner circumferential surface of the hollow casing (20) is provided with positioning grooves (21) corresponding to the first positioning ribs (41), and the location and co-operation of the positioning sleeves (40) and the hollow casing (20) along the circumferential direction are achieved through location of the first positioning ribs (41) on the positioning grooves (21); or, a collar (22) is fixedly sleeved inside the hollow casing (20), the inner circumferential surface of the collar (22) is provided with positioning grooves (21) corresponding to the first positioning ribs (41), and the location and co-operation of the positioning sleeves (40) and the hollow casing (20) along the circumferential direction are achieved through the first positioning ribs (41) and the positioning grooves (21).

Preferably, second positioning ribs (33) extending in an axial direction are arranged on the outer circumferential surfaces of the adaptor mechanism (30), the inner circumferential surface of the hollow casing (20) is provided with the positioning grooves (21) corresponding to the second positioning ribs (33), and the location and co-operation of the adaptor mechanisms (30) and the hollow casing (20) along the circumferential direction are achieved through location of the second positioning ribs (33) on the positioning grooves (21); or a collar (22) is fixedly sleeved inside the hollow casing (20), the inner circumferential surface of the collar (22) is provided with positioning grooves (21) corresponding to the second positioning ribs (33), and the location and co-operation of the adaptor mechanisms (30) and the hollow casing (20) along the circumferential direction is achieved through the second positioning ribs (33) and the positioning grooves (21).

Preferably, the adaptor mechanisms (30) are provided with radial through holes (31) to engage the support poles (80) in an insertion manner, the lower parts of the support poles (80) are provided with support steps (82), and the support steps (82) are abutted against and co-operated with the lower end of the hollow casing (20).

Preferably, the upper parts of the support pole (80) are provided with locking slot (81), and the adaptor mechanisms (30) are provided with latch mechanisms (60) locked and co-operated with or unlocked and co-operated with the locking slots (81) of the support poles (80).

Further, the hollow casing (20) is also provided with a keying mechanism (70), the latch mechanisms (60) are provided with a pushing surface (61), the keying mechanism (70) includes a button (71) and putters (72), the button (71) is exposed out of the outer circumference of the hollow casing (20), one ends of the putters (72) are linked and co-operated with the button (71), and the other ends are abutted against and co-operated with the pushing surfaces (61).

The present disclosure has the beneficial effects that:

according to the present utility, the adaptor mechanisms and the damping mechanisms are respectively and separately positioned, and therefore the adaptor mechanisms and the damping mechanisms are relatively separated, and force transmission between the adaptor mechanisms and the damping mechanisms does not happen, thereby improving the integral installation strength of the toilet cover;

according to the present disclosure, the damping shaft of the damping mechanism is externally sheathed with a positioning sleeve to achieve the position the damping mechanism along the circumferential direction, so that the damping mechanism is relatively fixed in the hollow casing along the circumferential direction, and the structure is simple and compact;

according to the present disclosure, the collar is further arranged in the hollow casing, and the thickness of the collar can be designed or selected according to a difference value between the internal diameter of the hollow casing and the external diameter of the damping mechanism or the adaptor mechanism, thereby enlarging an applicable range.

BRIEF DESCRIPTION OF THE DRAWINGS

The drawings described here are used for further understanding the present disclosure and constitute one part of the present disclosure, the illustrative examples, and description of the present disclosure are used for explaining the present disclosure but not improperly defining the present disclosure. In the drawings.

DETAILED DESCRIPTION

In order to solve the technical problem, and for the technical solution, and beneficial effects to be solved by the present disclosure more clearly understood, the present disclosure will be further described in detail in combination with the following drawing and implementations. It should be understood that the implementations described here are only for explaining the present disclosure but not limiting thereto.

Figure 1:
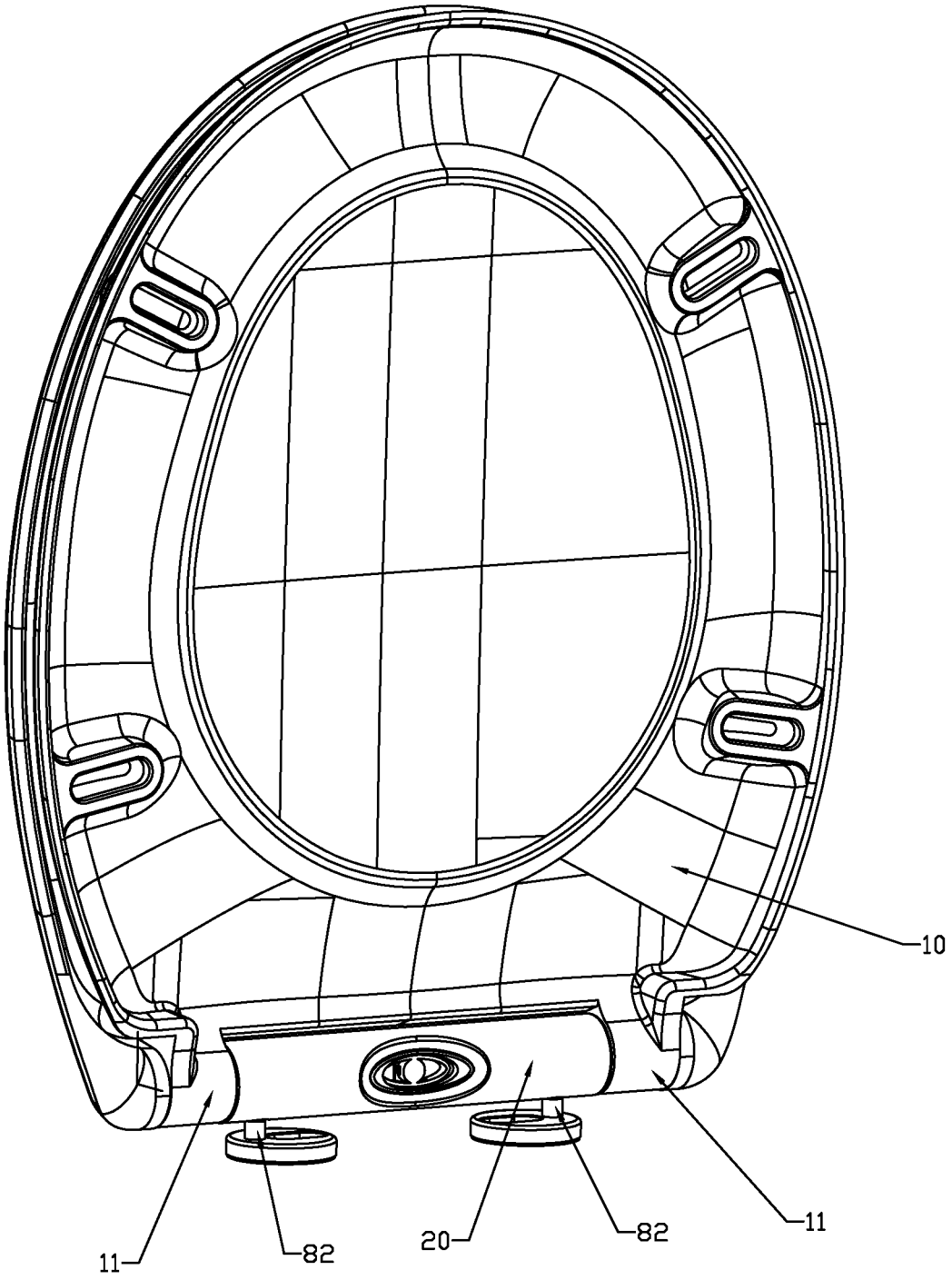
FIG. 1 is an assembly structure diagram of a quick detachable toilet cover according to the present disclosure.
Figure 2:
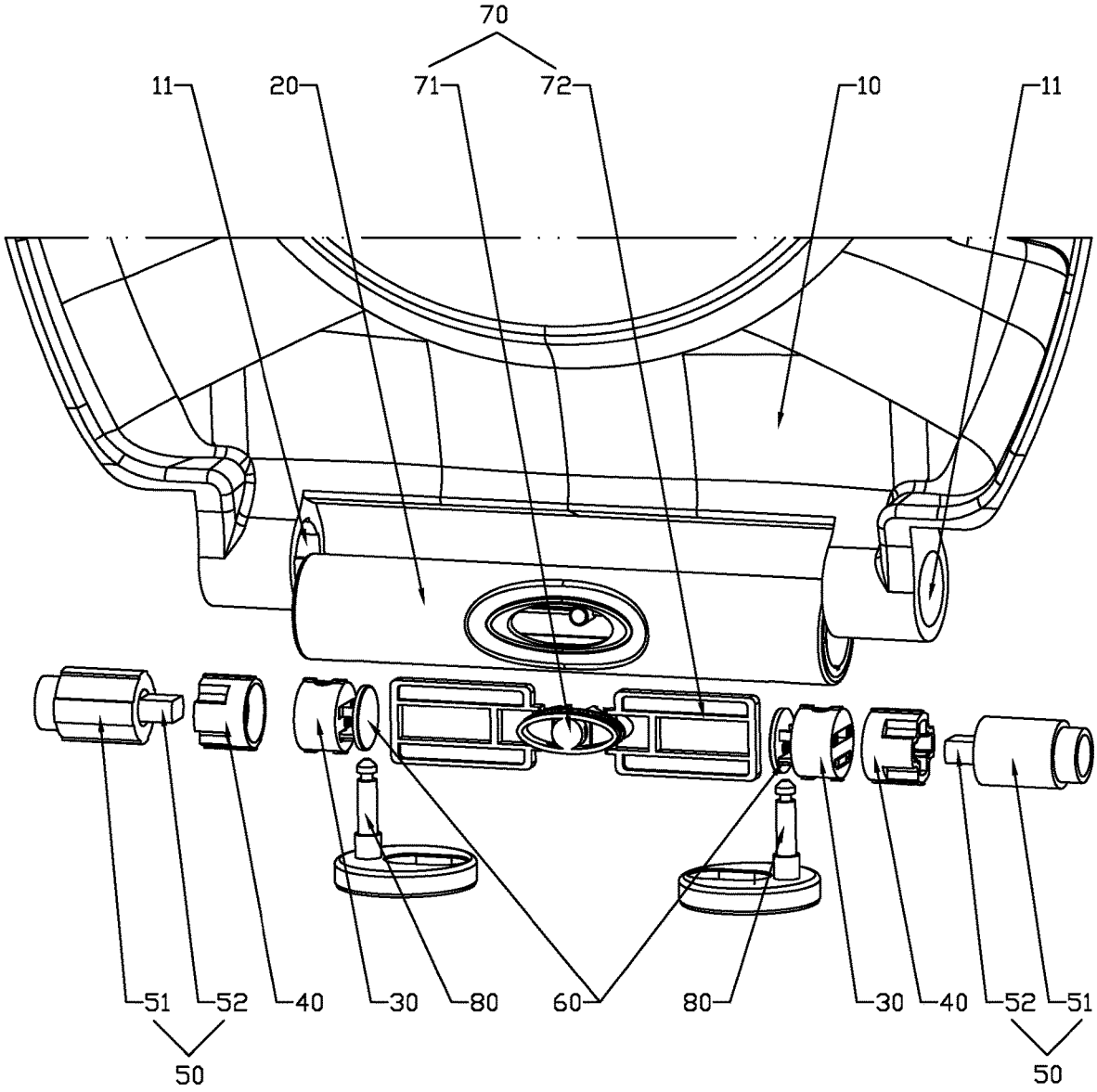
FIG. 2 is an exploded structure view of a quick detachable toilet cover according to the present disclosure.
Figure 3:
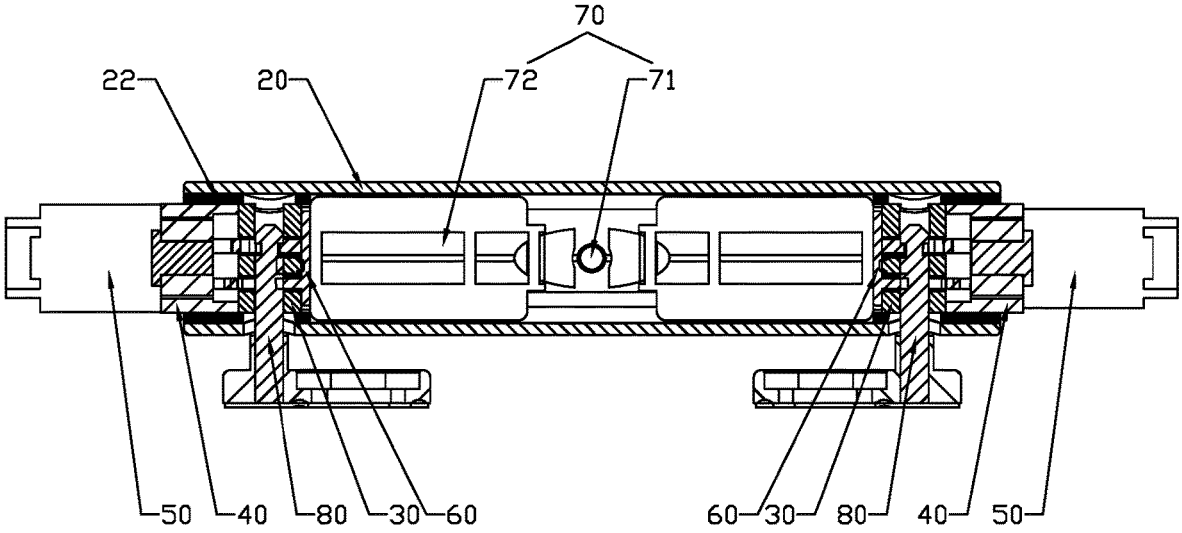
FIG. 3 is a sectional view of a mounting bracket of a quick detachable toilet cover according to the present disclosure.

As shown in FIG. 1 to FIG. 3, the present disclosure provides a quick detachable toilet cover, including a hollow casing 20 which is arranged at the rear end of a cover assembly 10 as well as adaptor mechanisms 30 and damping mechanisms 50 which are axially and serially arranged in the hollow casing 20, wherein the adaptor mechanisms 30 are matched with support poles 80 on a toilet seat body in an insertion manner, and the damping mechanisms 50 are connected between the cover assembly 10 and the hollow casing 20; the damping mechanisms 50 are also sheathed with positioning sleeves 40, the damping mechanisms 50 are positioned and matched with the positioning sleeves 40 along a circumferential direction, and the positioning sleeves 40 are positioned and matched with the hollow casing 20 along a circumferential direction.

The damping mechanism 50:

As shown in FIG. 2, the damping mechanisms 50 include damping seats 51 and damping shafts 52, the positioning sleeves 40 are provided with positioning cavities 42, and in this implementation, the insertion of the damping shafts 52 into the positioning cavities 42 achieves the positioning and matching along the circumferential direction. The rear end of the cover assembly 10 is also provided with integrated sleeve holes 11, and the hollow casing 20 and the sleeve holes 11 are communicated; the damping seats 51 are extended into the sleeve holes 11 and positioned and matched with the sleeve holes 11 along a circumferential direction. In this implementation, the damping mechanisms 50 and the adaptor mechanisms 30 are in touch matching, and both of them have no force transmission.

Figure 4:
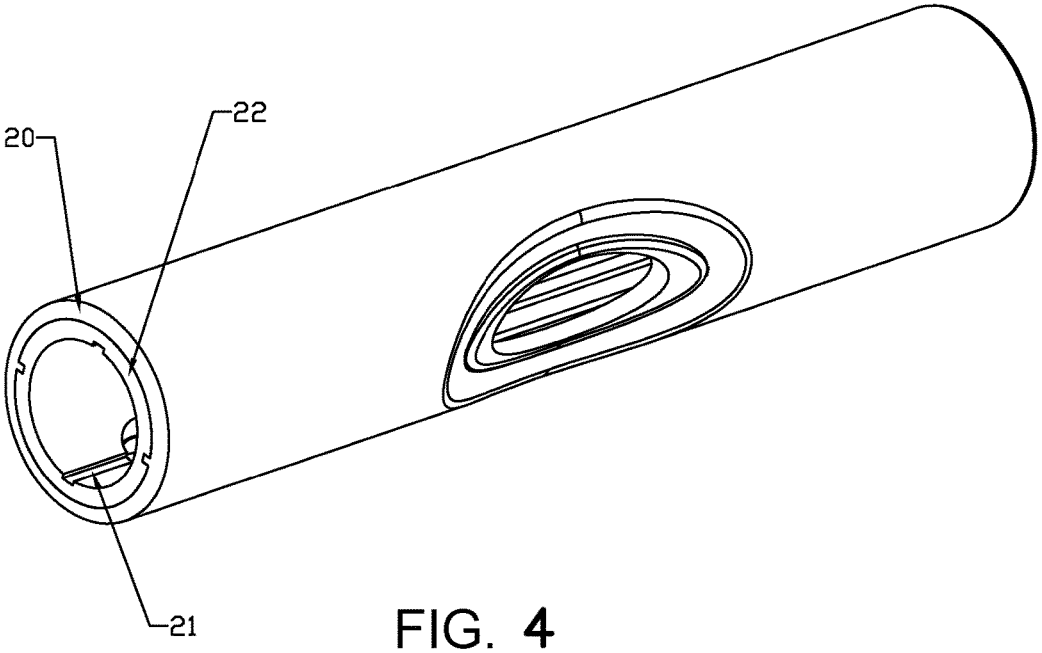
FIG. 4 is a sectional view of a hollow casing of a quick detachable toilet cover according to the present disclosure.
Figure 5:
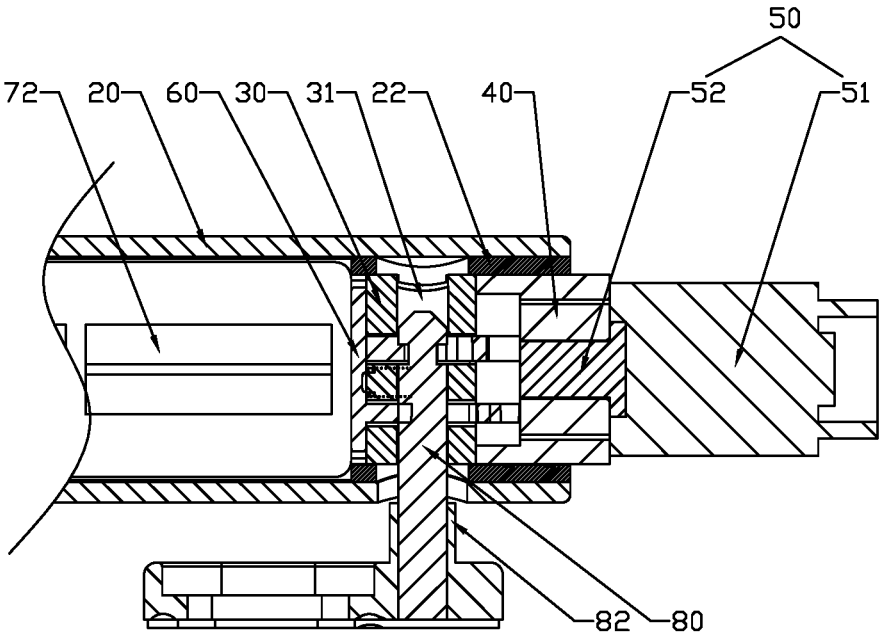
FIG. 5 is a partial sectional view of the mounting bracket of the quick detachable toilet cover according to the present disclosure.
Figure 7:
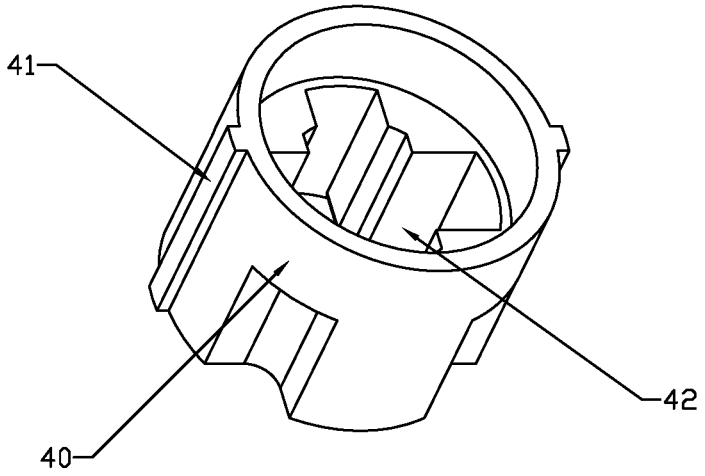
FIG. 7 is a first structure diagram of a positioning sleeve of a quick detachable toilet cover according to the present disclosure.
Figure 8:
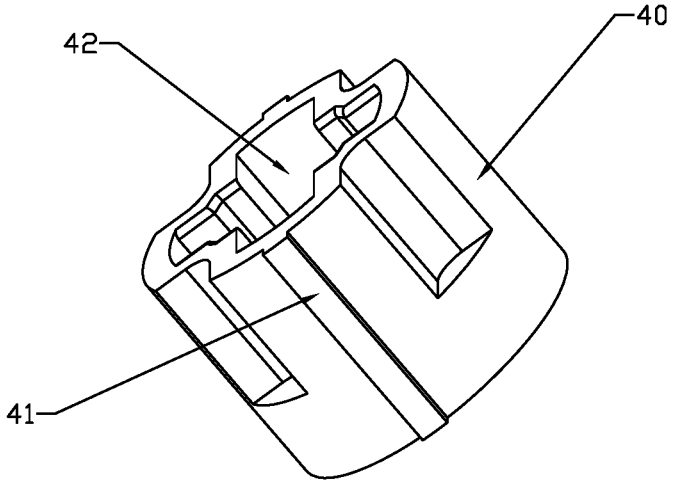
FIG. 8 is a second structure diagram of a positioning sleeve of a quick detachable toilet cover according to the present disclosure.

The positioning sleeve 40:

As shown in FIG. 7 and FIG. 8, first positioning ribs 41 extending in an axial direction are arranged on the outer circumferential surfaces of the positioning sleeve 40, the inner circumferential surface of the hollow casing 20 is provided with positioning grooves 21 corresponding to the first positioning ribs 41, and the positioning and matching of the positioning sleeves 40 and the hollow casing 20 along the circumferential direction are achieved through matching of the first positioning ribs 41 and the positioning grooves 21; or, for a situation that the diameter of the hollow casing 20 is large, as shown in FIG. 4, a collar 22 is fixedly sleeved inside the hollow casing 20, the inner circumferential surface of the collar 22 is provided with the positioning grooves 21 corresponding to the first positioning ribs 41, the positioning and matching of the positioning sleeves 40 and the hollow casing 20 along the circumferential direction are achieved through the first positioning ribs 41 and the positioning grooves 21, and therefore the applicable range of the present disclosure is wider.

Figure 11:
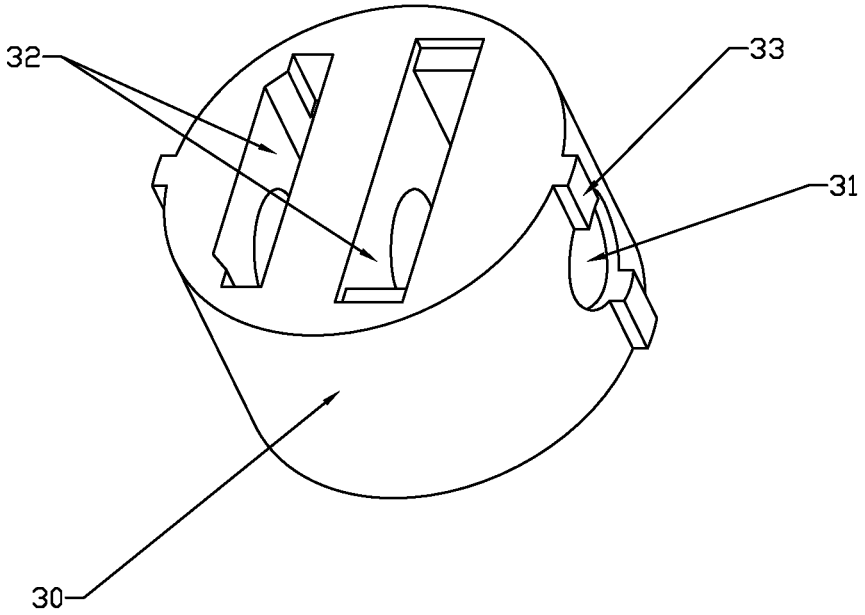
FIG. 11 is a first structure diagram of a latch mechanism of a quick detachable toilet cover according to the present disclosure.
Figure 12:
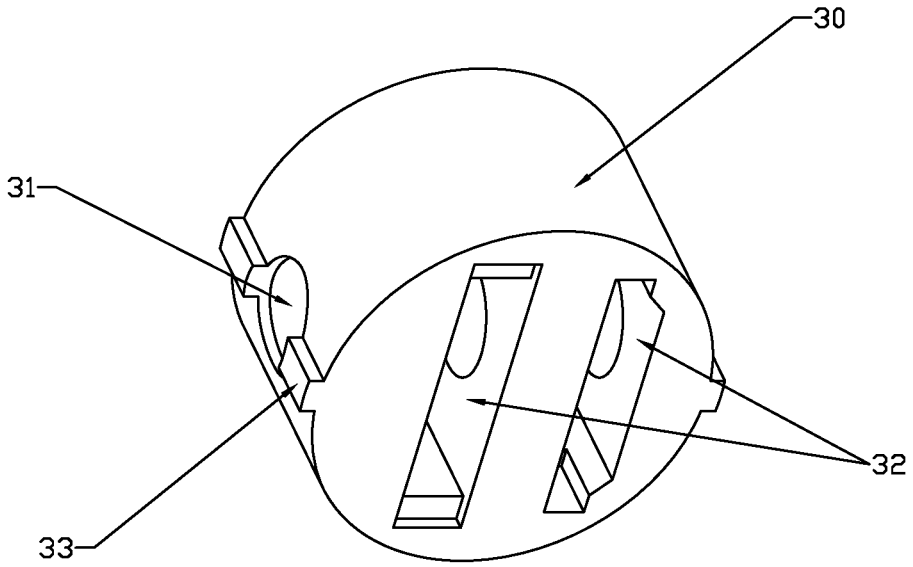
FIG. 12 is a second structure diagram of a latch mechanism of a quick detachable toilet cover according to the present disclosure.

The adaptor mechanism 30:

As shown in FIG. 11 to FIG. 12, second positioning ribs 33 extending in an axial direction are arranged on the outer circumferential surfaces of the adaptor mechanism 30, the inner circumferential surface of the hollow casing 20 is provided with positioning grooves 21 corresponding to the second positioning ribs 33, and the positioning and matching of the adaptor mechanisms 30 and the hollow casing 20 along the circumferential direction are achieved through matching of the second positioning ribs 33 and the positioning grooves 21; or for a situation that the diameter of the hollow casing 20 is large, as shown in FIG. 4, a collar 22 is fixedly sleeved inside the hollow casing 20, and the inner circumferential surface of the collar 22 is provided with positioning grooves 21 corresponding to the second positioning ribs 33, and positioning and matching of the adaptor mechanisms 30 and the hollow casing 20 along the circumferential direction are achieved through the second positioning ribs 33 and the positioning grooves 21. Wherein, the positioning sleeves 40 and the adaptor mechanisms 30 can share one collar 22, and the first positioning ribs 41 of the positioning sleeves 40 and the second positioning ribs 33 of the adaptor mechanisms 30 are axially aligned, preferably, and therefore the positioning grooves 21 can be shared. Moreover, as shown in FIG. 11 and FIG. 12, the adaptor mechanisms 30 are provided with radial through holes 31 matched with the support poles 80 in an insertion manner.

Figure 6:
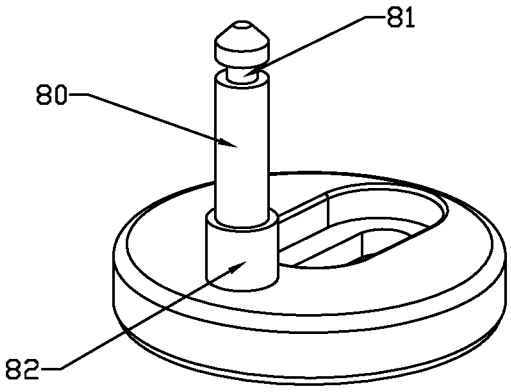
FIG. 6 is a structural diagram of a support pole of a quick detachable toilet cover according to the present disclosure.
Figure 9:
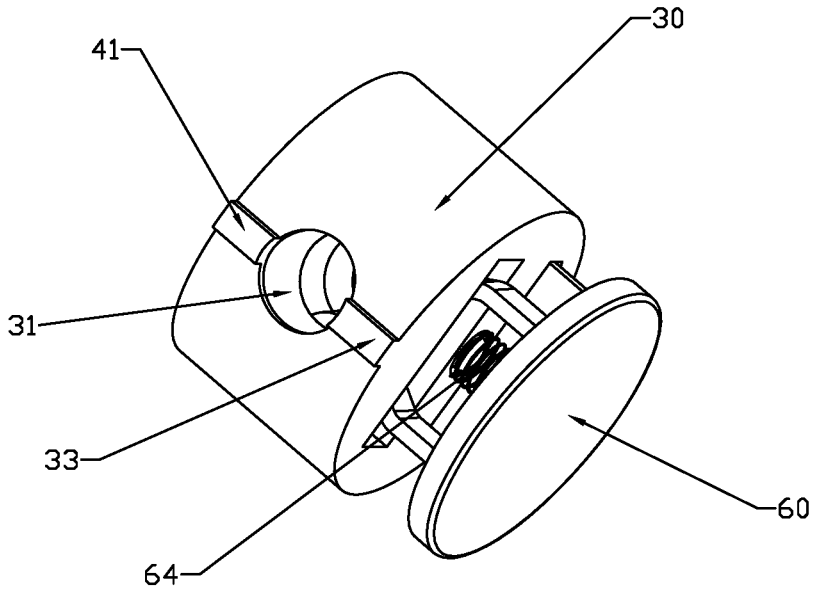
FIG. 9 is an assembly structure diagram of an adaptor mechanism and a latch mechanism of a quick detachable toilet cover according to the present disclosure.
Figure 10:
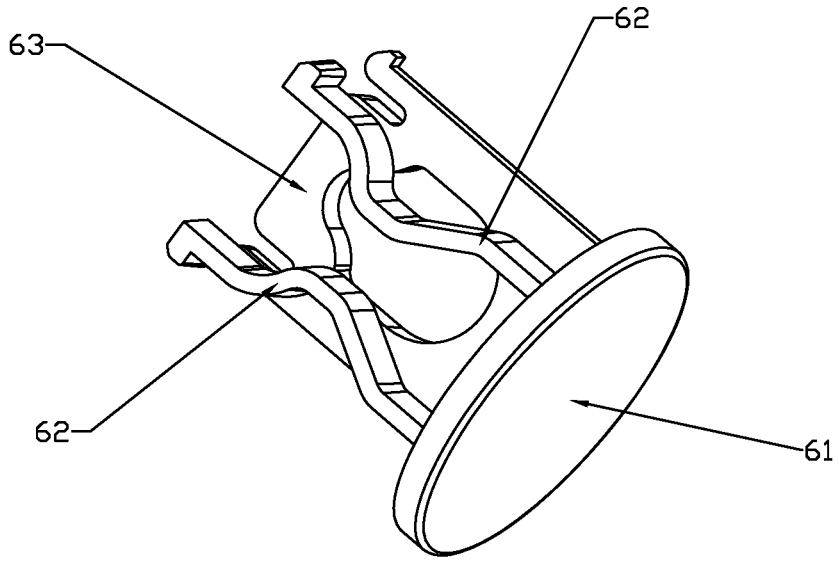
FIG. 10 is a structure diagram of a latch mechanism of a quick detachable toilet cover according to the present disclosure.

The support poles 80:

As shown in FIG. 6, the lower parts of the support poles 80 are provided with support steps 82, and the support steps 82 are abutted against and matched with the lower end of the hollow casing 20. The upper parts of the support poles 80 are provided with locking slots 81, and the adaptor mechanisms 30 are provided with latch mechanisms 60 locked and matched with or unlocked and matched with the locking slots 81 of the support poles 80 (as shown in FIG. 9 and FIG. 10).

The keying mechanism 70:

As shown in FIG. 2 and FIG. 3, in this implementation, the hollow casing 20 is also provided with a keying mechanism 70, the latch mechanisms 60 are provided with pushing surfaces 61, the keying mechanism 70 includes a button 71 and putters 72, the button 71 is exposed out of the outer circumference of the hollow casing 20, one ends of the putters 72 are linked and matched with the button 71, and the other ends are abutted against the pushing surfaces 61. In this implementation, a single key unlock control structure is used, the button 71 is arranged in the middle of the hollow casing 20, and two putters 72 in linking and matching with the button 71 are symmetrically arranged at the two sides of the button 71 respectively, and the unlock control of the latch mechanisms 60 at the two sides is performed through the putters 72.

The latch mechanism 60:

As shown in FIG. 9 and FIG. 10, in this implementation, the latch mechanisms 60 include pushing surfaces 61 being in pushing and matching with the putters 72, and the other sides of the pushing surfaces 61 are provided with button legs 62 and cards 63 which respectively extend along an axial direction, the adaptor mechanisms 30 are provided with two card grooves 32 correspondingly clamped and matched with the button legs 62 and the cards 63, and the adaptor mechanisms 30 further include reset elastic elements 64 abutted between the latch mechanisms 60 and the adaptor mechanisms 30. When in a locked state, small card holes formed on the cards 63 are clamped and matched with the locking slots 81 of the support poles 80; when in an unlocked state, the button 71 is operated to drive the putters 72 to forwardly push the pushing surfaces 61 so that the cards 63 move to the locations of large card holes being in reserved connection with the locking slots 81, at this moment, the button legs 62 clamp the support poles 80 so that the locked state is kept between the support poles 80, which is convenient for a user to easily pull out the cover assembly 10.

Certainly, the present disclosure is also applicable to a control mechanism of which two sides are respectively unlocked, that is, two latch mechanisms 60 are directly pressed and unlocked. Or, the present disclosure is also applied to other non-keying mechanisms, such as a mechanism that is unlocked by overturning the cover, but not limited thereto.

The above description illustrates and describes implementations of the present disclosure, as previously mentioned, the present disclosure is not limited to the form disclosed herein, should not be considered as excluding other implementations and can be used for various other combinations, modifications and environments, and changes can be made through the above teachings or technologies or knowledge of related fields within the scope thought in the present disclosure. Modifications and changes made by those skilled in the art do not depart from the spirit and scope of the present disclosure, and are all included within the protection scope of claims appended by the present disclosure.

What is claimed is:

1. A quick detachable toilet cover, comprising:

a hollow casing, arranged at a rear end of a cover assembly;

adaptor mechanisms; and damping mechanisms, the adaptor mechanisms and the damping mechanisms being axially and serially arranged in the hollow casing, the adaptor mechanisms being matingly engageable with support poles on a toilet seat body, the damping mechanisms being connected between the cover assembly and the hollow casing, the damping mechanisms being sheathed with positioning sleeves, the damping mechanisms being disposed at and cooperating with the positioning sleeves along a circumferential direction, and the positioning sleeves being disposed at and cooperating with the hollow casing along a circumferential direction, wherein, the adaptor mechanisms comprise radial through holes to engage with the support poles, lower parts of the support poles comprise support steps, and the support steps abut against and co-operate with a lower end of the hollow casing.

2. The quick detachable toilet cover of claim 1, wherein the damping mechanisms comprise damping seats and damping shafts, the positioning sleeves comprise positioning cavities, and the damping shafts being inserted into the positioning cavities to achieve positioning and matching along a circumferential direction.

3. The quick detachable toilet cover of claim 1, wherein the rear end of the cover assembly comprise integrated sleeve holes, the hollow casing and the integrated sleeve holes are in contact, and damping seats extend into the integrated sleeve holes and are located at and cooperate with the integrated sleeve holes along a circumferential direction.

4. The quick detachable toilet cover of claim 1, wherein the quick detachable toilet cover further comprises first positioning ribs extending in an axial direction arranged on outer circumferential surfaces of the positioning sleeves, an inner circumferential surface of the hollow casing comprises positioning grooves corresponding to the first positioning ribs, and the positioning sleeves and the hollow casing are located and cooperate along the circumferential direction by locating the first positioning ribs on the positioning grooves.

5. The quick detachable toilet cover of claim 1, wherein the quick detachable toilet cover further comprises second positioning ribs extending in an axial direction arranged on outer circumferential surf aces of the adaptor mechanisms, an inner circumferential surface of the hollow casing comprises positioning grooves corresponding to the second positioning ribs, and the adaptor mechanisms and the hollow casing are located and cooperate along the circumferential direction by locating the second positioning ribs on the positioning grooves.

6. The quick detachable toilet cover of claim 5, wherein upper parts of the support poles comprise locking slots, and the adaptor mechanisms comprise latch mechanisms, and wherein the latch mechanisms are locked and cooperate with the locking slots of the support poles, or the latch mechanisms are unlocked and match with the locking slots of the support poles.

7. The quick detachable toilet cover of claim 6, wherein the hollow casing comprises a keying mechanism, the latch mechanisms comprise pushing surfaces, the keying mechanism comprises a button and putters, the button is exposed out of an outer circumference of the hollow casing, first ends of the putters are linked and cooperate with the button, and second ends of the putters abut against and cooperate with the pushing surfaces.

8. The quick detachable toilet cover of claim 1, wherein the quick detachable toilet cover further comprises a collar fixedly sleeved inside the hollow casing, an inner circumferential surface of the collar comprises positioning grooves corresponding to first positioning ribs, and the positioning sleeves and the hollow casing are located and cooperate along the circumferential direction through the first positioning ribs and the positioning grooves.

9. The quick detachable toilet cover of claim 1, wherein the quick detachable toilet cover further comprises a collar fixedly sleeved inside the hollow casing, an inner circumferential surface of the collar comprises positioning grooves corresponding to second positioning ribs, and the adaptor mechanisms and the hollow casing are located and cooperate along the circumferential direction through the second positioning ribs and the positioning grooves.

10. The quick detachable toilet cover of claim 1, wherein the adaptor mechanisms comprise radial through holes matched to the support poles, lower parts of the support poles comprise support steps, and the support steps abut against and match with a lower end of the hollow casing.

11. The quick detachable toilet cover of claim 1, wherein upper parts of the support poles comprise locking slots, and the adaptor mechanisms comprise latch mechanisms, and wherein the latch mechanisms are locked and match with the locking slots of the support poles, or the latch mechanisms are unlocked and match with the locking slots of the support poles.

* * * * *